United States Patent [19]

Kremer et al.

[11] 3,979,161

[45] Sept. 7, 1976

[54] COPYING MACHINE FIRE SNUFFER

[75] Inventors: David G. Kremer, Telford, Pa.; Mosi Chu, Long Island City, N.Y.

[73] Assignee: Sperry Rand Corporation, New York, N.Y.

[22] Filed: Mar. 18, 1975

[21] Appl. No.: 559,571

[52] U.S. Cl. ..... 355/133; 118/637; 352/144; 355/3 R

[51] Int. Cl.[2] ..... G03G 15/00

[58] Field of Search ..... 355/133, 3 R, 3 DD, 355/3 FU, 30, 14; 352/144; 118/637

[56] References Cited

UNITED STATES PATENTS

| | | | |
|---|---|---|---|
| 1,845,840 | 2/1932 | Holman | 352/144 |
| 3,357,401 | 12/1967 | Wood | 355/14 X |
| 3,804,516 | 4/1974 | Mott | 355/14 X |
| 3,809,475 | 5/1974 | Post et al. | 355/14 X |

*Primary Examiner*—R. L. Moses

*Attorney, Agent, or Firm*—Griffin, Branigan and Butler

[57] ABSTRACT

A copying machine for making copies on individual copy sheets includes a fire-extinguishing snuffer located downstream of a fuser. The fire-extinguishing snuffer comprises a pair of flat metallic plates for defining between them a flat-shaped 0.1 to 0.125 inch gap and guiding wire springs for guiding the leading edges of individual copy sheets into this gap while not impeding the flow of the copy sheets.

2 Claims, 3 Drawing Figures

COPYING MACHINE FIRE SNUFFER

BACKGROUND OF THE INVENTION

This invention relates broadly to the art of electrostatographic printing machines, and more particularly to apparatus for extinguishing fires originating in fusing devices thereof.

In many electrostatographic printing machines, copy sheets having toner powder images thereon are conveyed through fusing devices for fusing the images to the copy sheets. The fusing devices, or fusers, generate sufficient heat to permanently fix the heat sensitive toner particles to the copy sheets.

It sometimes inadvertently occurs that the temperatures created by the fusers exceed the kindling temperatures of the copy sheets and thereby cause fires. Such fires, if not quickly extinguished, could spread and thereby result in great damage to the printing machines requiring expensive repair.

Petents which describe sensors for sensing the likelihood or presence of such fires include U.S. Pat. Nos. 3,705,289 to Szostak et al, 3,748,088 to Mooney et al, and 3,804,516 to Mott. Further, U.S. Pat. No. 3,778,222 to Suzuki describes a device to be used with an electrostatographic printer wherein, when a fire is detected in a fuser the ends of the fuser are shut to prevent the spread of this fire beyond the fuser. However, these devices do not appear to extinguish the fires, which would be desirable. Thus, it is an object of this invention to provide a fire extinguishing apparatus for an electrostatographic photocopy machine which effectively extinguishes fires caused by fusers.

It has been suggested to employ a fire wiper-snuffer downstream of a fuser which includes a broad, flat spring to wipe across the tops of copy sheets as they exit from the fuser. However, it has been found that such a device provides undue loading of light-weight copy sheets causing them to buckle and thereby jam in the machine.

A snuffer system is disclosed in U.S. Pat. No. 1,845,840 to Holman for extinguishing fires on a film in a motion picture projector. In this case, the film is pulled between plates which are separated a distance of 1/16 of an inch. The fires are choked for lack of oxygen within the confined space between the plates and the metallic plates reduce the temperature of a flame below the ignition temperature of the film. Although this system may be effective where film is pulled through a gap, it would not appear to work well for copying machines. Such a small gap would load copy sheets to such an extent that many of them would buckle and jam the machine. Also, it would be difficult to guide the leading edges of copy sheets into Holman's gap. Thus, it is yet another object of this invention to provide an effective fire snuffer for an electrostatographic copying machine which does not unduly impede the flow of individual copy sheets.

SUMMARY

According to a principle of this invention a fire snuffer is located downstream of a fuser. The fire snuffer includes a pair of flat metallic plates for defining a flat-shaped, 0.1 to 0.125 inch gap therebetween, and being arranged so that the copy sheets pass through this gap. The fire snuffer also includes wire springs for guiding the leading edges of copy sheets into the gap while not impeding the copy sheets' flow.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 3:
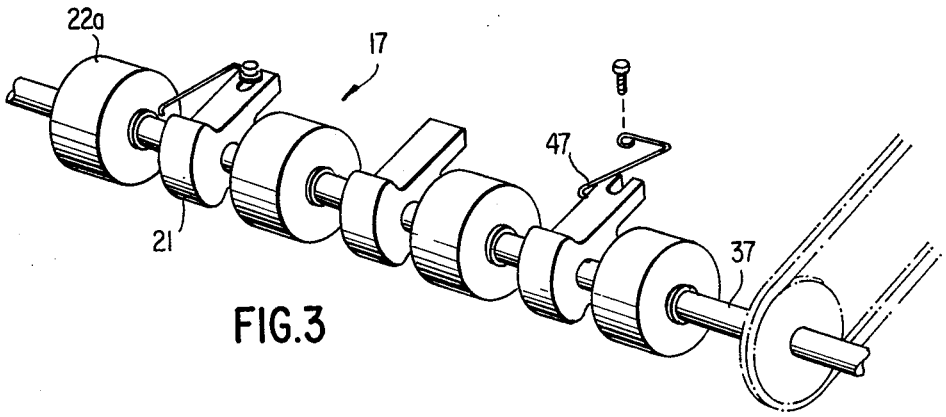
FIG. 3 is a partially exploded, isometric view of flip-out springs of FIG. 1 mounted on a gripper-bar release cam assembly.

The printing machine depicted in the drawings includes a photoconductive drum 11, two parallel transport chains 13 (not shown), gripper bars 15 (one shown), a gripper-bar release-cam assembly 17 and a fuser 19. For more details on the operation of this system, reference can be made to U.S. Pat. No. 3,797,929 to Deacon et al. Basically, movable jaws of the gripper-bars 15 are opened and closed by stationary cams, such as cams 21 (FIG. 3) of the cam assembly 17, to grip and release copy sheets. The gripper bars 15 transport the copy sheets past the photoconductive drum 11, under the fuser 19 and to a first set of exit-feed rolls 22.

The copy sheets are heated by the fuser 19 and it is at this point that a fire could occur. Thus, a fire extinguishing apparatus in the form of a snuffer 23 is positioned between the first set of exit feed rolls 22 and a second set of exit feed rolls 24.

The snuffer 23 comprises upper and lower metallic baffles 25 and 27 which are between 0.1 and 0.125 inches apart to form an orifice or gap 28 at a throat extinguishing area 29. The throat extinguishing area 29 is 1.5 inches long in the direction of sheet flow and is at least as wide as the widths of the copy sheets. The lower baffle 27 is attached by means of a bracket 31 to members 33 of the photocopy machine, the position of which is keyed to the position of lower, second exit feed rolls 24*a*. It can be seen in FIG. 3 that lower first exit rolls 22*a* are mounted on the same shaft 37 as are the cams 21. The upper baffle 25 is attached to the lower baffle 27 by means of pins 39 with spacers 41, as can be seen in detail in FIG. 2.

Figure 1:
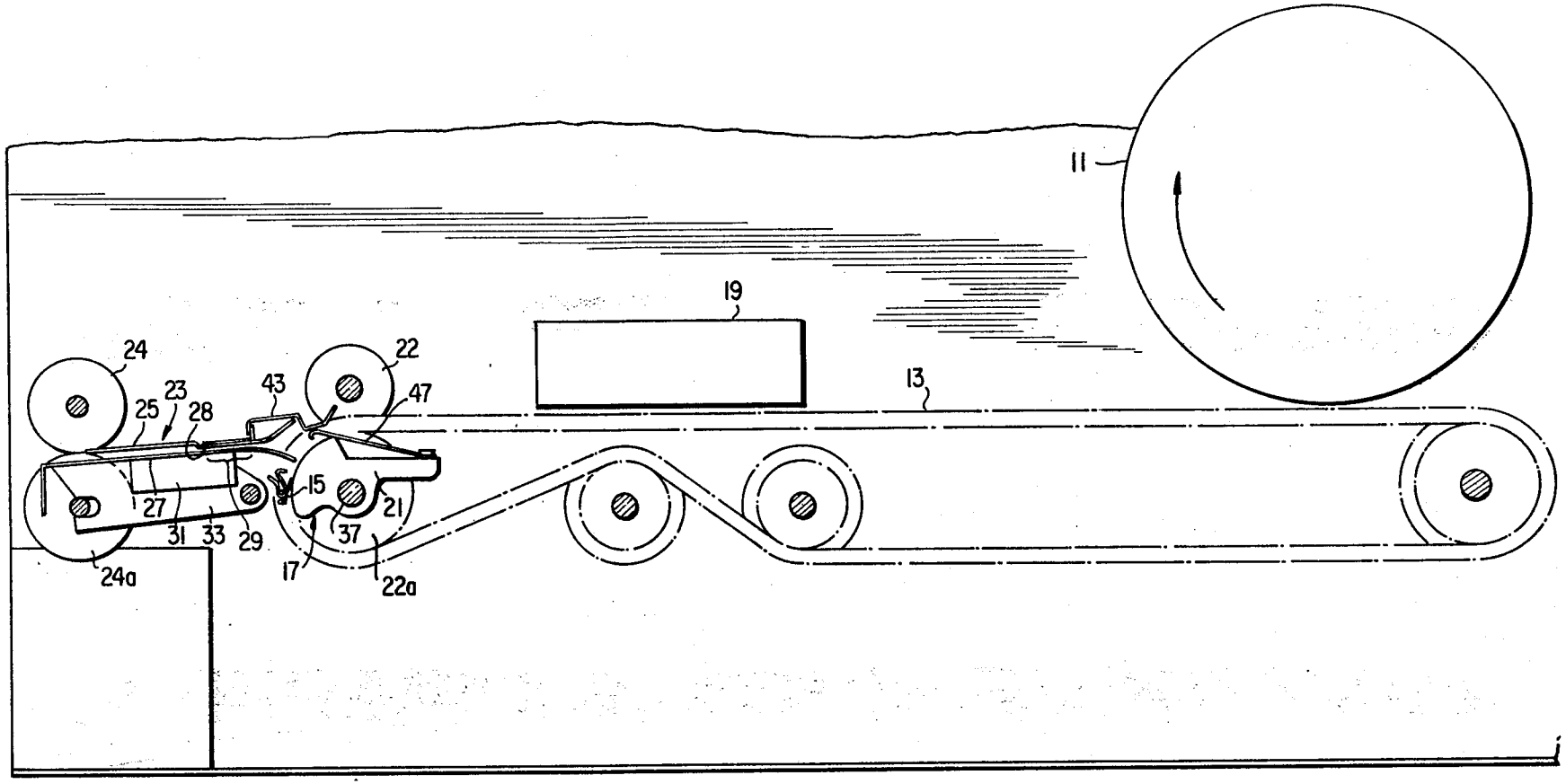
FIG. 1 is a side view of applicable portions of an electrostatographic printing machine which includes a fire snuffer according to principles of this invention.
Figure 2:
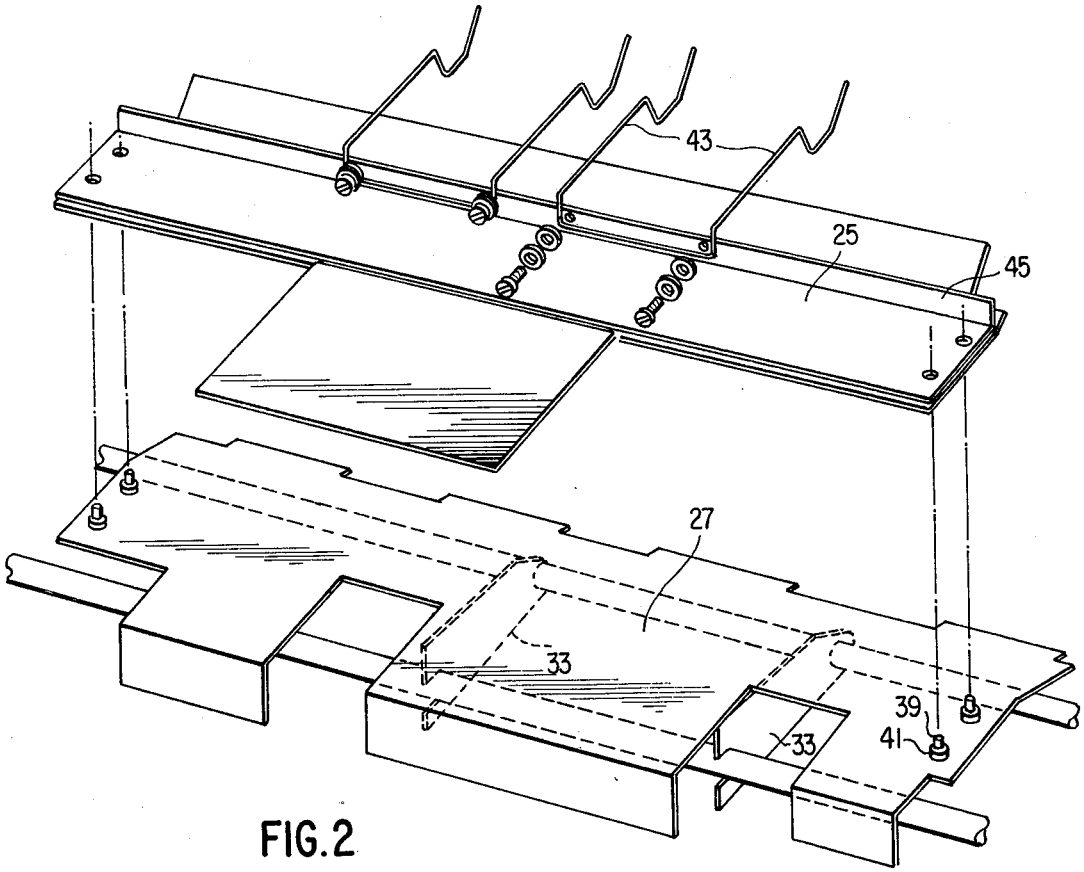
FIG. 2 is an exploded, isometric view of the fire snuffer of FIG. 1.

The upper and lower baffles 25 and 27 are flared at the upstream ends thereof to permit easy entry of copy sheets. In addition, wire-like guide springs 43 are attached to the upper side of the upper baffle 25 by means of a bracket 45, as is shown in FIG. 2, to help guide copy sheets into the gap 28 between the upper and lower baffles 25 and 27. The guide springs 43 extend forwardly over the upper baffle 25 and then bend downwardly in front of the flared upstream end of the upper baffle. These springs then flare upwardly to insure that they catch forward edges of the copy sheets and urge them downwardly. Further, flip-out spring 47 are attached to the cams 17 and slope upwardly in a downstream direction, terminating at a point just below the guide springs 43 to urge copy sheets that bow downwardly, upwardly. Together, the guide springs 43 and the flip-out springs 47 cooperate to direct forward edges of copy sheets into the gap 28.

In operation, a gripper bar 15 grips a copy sheet and transports it past the photoconductive drum 11 and the fuser 19. The copy sheet is then gripped by the first set of exit feed rolls 22 and the gripper bar assembly 15 is actuated by the cams to release the copy sheet. The flip-out springs 47 lift the forward edge of the copy sheet out of the jaws of the gripper bar assembly 15. The guide springs 43 and the flip-out springs 47 then cooperate to guide the paper at the correct attitude into the gap 28. As the copy sheet is fed through the gap 28 of the throat extinguishing area 29 by the first and second sets of exit feed rolls 22 and 24 any fires that are present on the copy sheet are extinguished quickly and effectively between the baffles by heat sinking of the upper and lower baffles 25 and 27 and a lack of oxygen in the gap 28.

It has been found that if the orifice, or gap size between the upper and lower baffles 25 and 27 in the throat extinguishing area 29 is less than 0.1 inches there is a danger of paper getting caught or jammed in the snuffer. On the other hand, it has also been found that if the orifice is greater than 0.125 inches there is a danger of a copy-sheet fire getting through the snuffer only partially extinguished. In this regard, during tests this system has proved to be extremely effective. No jams of any sort were experienced for over two thousand copies on various size papers, prints, transparencies and label stocks, including paper torn from a yellow scratch pad.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed are defined as follows:

1. A printing machine for printing images on individual copy sheets comprising:

a copy-sheet transporting system for transporting copy sheets along a predetermined path through a plurality of stations;

a transfer means at a transfer station for transferring heat sensitive developing material to said copy sheets in concentrations representative of said images;

a fusing means at a fusing station for heating said developing material on said copy sheets when said copy sheets are transported through said fusing station;

a fire-extinguishing snuffer for extinguishing fires on said copy sheets caused by the heat of said fusing means said fire-extinguishing snuffer being located downstream of said fusing means at an extinguishing station, said fire snuffer including a pair of flat metallic plates for defining a flat-shaped 0.1 to 0.125 inch gap therebetween and being arranged so that said copy sheets pass through said gap, said plates having a width at said gap which is greater than the widths of said copy sheets; and, a guidance means including upper and lower wire-like guidance springs upstream of said fire-extinguishing snuffer for directing the leading edges of said copy sheets into said gap.

2. A copy machine as claimed in claim 1 wherein a first set of springs on one side of said gap is attached upstream of said fire-extinguishing snuffer and extends in the downstream direction from said attachment toward said snuffer to urge said paper sheets toward the opposite side of said gap and wherein a second set of springs on the opposite side of said gap is attached to said snuffer and extends upstream in front of said snuffer to urge said paper sheets toward said one side of said gap.

* * * * *